US007226533B2

(12) United States Patent
Angulo Aramburu

(10) Patent No.: US 7,226,533 B2
(45) Date of Patent: Jun. 5, 2007

(54) PROCESS FOR RE-REFINING USED OILS BY SOLVENT EXTRACTION

(75) Inventor: Jerónimo Angulo Aramburu, Madrid (ES)

(73) Assignee: Sener Grupo De Ingenieria, S.A., Madrid (ES)

( * ) Notice: Subject to any disclaimer, the term of this patent is extended or adjusted under 35 U.S.C. 154(b) by 595 days.

(21) Appl. No.: 10/270,410

(22) Filed: Oct. 10, 2002

(65) Prior Publication Data

US 2004/0007499 A1 Jan. 15, 2004

Related U.S. Application Data

(63) Continuation of application No. PCT/ES02/00354, filed on Jul. 15, 2002.

(51) Int. Cl.
*C10G 19/02* (2006.01)
*C10G 21/00* (2006.01)

(52) U.S. Cl. ..... 208/179; 208/180; 208/181; 208/184; 208/86; 208/87

(58) Field of Classification Search ..... 280/179, 280/180, 181, 184, 185
See application file for complete search history.

(56) References Cited

U.S. PATENT DOCUMENTS

| | | | | |
|---|---|---|---|---|
| 3,565,791 A | | 2/1971 | Urquhart | |
| 3,791,965 A | | 2/1974 | Fitzsimons et al. | |
| 3,919,076 A | | 11/1975 | Cutler et al. | |
| 4,233,140 A | | 11/1980 | Antonelli et al. | |
| 4,336,639 A | | 6/1982 | Berglund | |
| 4,834,868 A | | 5/1989 | Lappin | |
| 4,941,967 A | | 7/1990 | Mannetje et al. | |
| 5,759,385 A | * | 6/1998 | Aussillous et al. | 208/187 |
| 5,843,384 A | * | 12/1998 | Aussillous et al. | 422/189 |

FOREIGN PATENT DOCUMENTS

| | | |
|---|---|---|
| BE | 873451 | 11/1980 |
| DE | 343336 | 5/1919 |
| EP | 0 574 272 B1 | 12/1993 |
| NL | 8304023 | 7/1990 |
| WO | 94/07798 | 4/1994 |
| WO | 94/21761 | 9/1994 |
| WO | 98/26031 | 6/1998 |

* cited by examiner

*Primary Examiner*—Tam M. Nguyen
(74) *Attorney, Agent, or Firm*—Katten Muchin Rosenman LLP

(57) ABSTRACT

A process to re-refine used petroleum oils by extraction with aliphatic solvents, wherein after eliminating the extract solvent, the process consists of the following treatments, (a) flash, continuous vaporization, at atmospheric pressure or near atmospheric pressure, to separate the light fractions, in the presence of small amounts of a basic compound or a reducing agent or a combination of both and (b) continuous distillation, in a fractionating column, of the bottom liquid obtained in stage (a), under vacuum and moderate temperatures, in the presence of a basic compound or a reducing compound or a combination of both, with recirculation from the bottom of the column to its feed; separating, as lateral extractions, the vacuum gas-oil or spindle oil and the lubricant bases and, as bottom product, a fuel-oil or asphaltic component.

12 Claims, 2 Drawing Sheets

PREVIOUS STATE OF THE ART

PROCESS FOR RE-REFINING USED OILS BY SOLVENT EXTRACTION

CROSS-REFERENCE TO RELATED APPLICATIONS

This application is a continuation application of PCT/ES02/00354 filed Jul. 15, 2002.

FIELD OF THE INVENTION

The invention is related, in general, with used oil re-refining, an industrial operation that consists in recovering the base oils, by separating them from the other products and contaminants, so that they can be used again as lubricant bases. More specifically, the invention describes a method for re-refining used petroleum oils, by extraction with aliphatic solvents, characterised by a process consisting of different separation stages, after eliminating the extraction solvent.

BACKGROUND OF THE INVENTION

Refined petroleum oils, which are used to manufacture lubricants and other industrial oils, are called lubricant bases or lube oil bases. Lubricants and other industrial oils are produced by mixing lubricant bases with additives, some of which contain metals (Ca, Zn, etc.), which confer them the required qualities for their application (resistance to oxidation, to shearing, and to temperature, emulsifying and anti-foaming qualities, minimum change in viscosity with temperature etc.). The oils, discarded after having been used in engines or other machines, are called used oils. They contain lubricant bases and additives and their breakdown products (lighter petroleum fractions such as naphtha and gas-oil, and heavier ones such as asphalt and coke). They also contain contaminants acquired during their collection from garages and petrol stations, such as water, glycol and solvents.

The separation of asphalts, additives and breakdown products is usually done by vacuum distillation of the oil bases. Said process involves heating the used oil to temperatures above 300° C., which produces cracking reactions that foul the heat exchange and distillation equipment and produce corrosion.

To reduce the equipment fouling, in the separation of asphalts and additives by distillation, several process have been used. Patent WO 9407798 (Viscolube Italiana Spa, 1994), treats the used oil with a strong base before separating the asphalts and additives and carries out this separation by distillation at moderate vacuum (20-30 mbars) and high temperatures (350° C.) under which the additive molecules are broken down. Patent WO 9421761 (Sotulub, Tunez, 1994) carries out a series of treatments with strong bases at 150-250° C. before the separation of asphalt and additives, which in this case is performed in a thin-layer vaporization equipment with very moderate temperatures (310° C.) and a high vacuum (1 mbar) to avoid cracking. Other processes ("The Vaxon Process", K. Kenton y J. Hedberg, First Intern. Congress on Liquid Waste Refining, May 23 1994, S. Francisco) use a series of flash vaporisations.

All these processes which separate asphalts and additives by distillation, require heating above 300° C. and thus produce lubricant bases with odour, color, acidity, corrosion etc. greater than those of an oil base from first refining, then requiring a final refining step. Traditionally, this final refining step has been done with sulphuric acid and adsorbent clays but this process has been almost abandoned because of its discontinuous character, because it produces sulphonated wastes difficult to manage and because it is costly. For this reason, patents NL 8304023 (KTI, 1985) or EP 574272 (Chem. Eng. Partners, 1993), among others, use catalytic hydrogenation systems, for this final refining step.

Nevertheless, because of the large investment required for catalytic hydrogenation, there is an attempt to search for alternatives. For example, in patent DE 343336 (Buss A. G., 1985), before separation of asphalts and additives by distillation, the oil is treated with alkaline hydroxides at 230-260° C. in a closed reactor, while the patent U.S. Pat. No. 4,834,868 (F. J. Lappin, 1989), carries out the treatment with alkaline hydroxide in the packing of the column used for the separation of asphalts and additives. Caustic treatment at 200-300° C., combined with oxidation, is carried out after the separation of asphalts and additives in patent WO 9826031 (Sotulub, Tunisia, 1994), requiring a final distillation of the lubricant bases after the caustic refining.

As an alternative to the separation of asphalts and additives by vacuum distillation, extraction processes, using liquid solvents, have been developed (solvent de-asphalting). These processes operate at near ambient temperatures, thus avoiding to a large extent the equipment fouling problems and the cracking of asphalts, additives and breakdown products since these are separated before distillation of the lubricant bases. The solvent most commonly used is liquid propane, which is described in several patents, such as BE 873451 (Snam Proggeti Spa, 1979).

In the solvent deasphalting process, propane extracts, by dissolution, preferentially naphtha, gas-oil and lubricant bases and rejects, as raffinate, the asphalts and water, which have low solubility in propane. The raffinate retains most of the additives, breakdown products, asphalts, and all of the water and glycols. After separating the propane by evaporation and recycling it, the extracted lubricant bases are submitted to atmospheric distillation to separate the light products, and to vacuum distillation to separate the gas-oil and lubricant bases. These bases still require a mild refining treatment with clay or hydrogenation to achieve the quality usually reached in the bases of first refining (Patents of Foster Wheeler Corp. U.S. Pat. No. 433,639, application on 16-1-74 and L. E. Cutler and E. T. Cutler, U.S. Pat. No. 3,919,076, Nov. 11, 1975).

Although the previous separation of asphalts and additives, at moderate temperatures by solvent de-asphalting reduce the fouling problems, these still persist because a small proportion of the additives are extracted with propane. For this reason, chemical pretreatments of the used oil, before the solvent deasphalting process, have been introduced. Those pre-treatments use basic compounds and phase transfer catalysts (J. Krzykawski, M. R. Williams, PCT US/99/116600) and increase the efficiency of the separation of additives in the deasphalting process thus reducing the fouling problems, but have not eradicated them altogether.

Current processes of used oil re-refining by extraction with aliphatic solvents (propane etc.) are characterised in that they require the following stages, which are outlined in FIG. 1 (previous technology):

1. De-asphalting with solvents (with or without chemical pretreatment).

2. Separation of the light products by distillation at atmospheric pressure.

3. Separation of the gas-oil and the bases by vacuum distillation.

4. Final refining of the bases (adsorbent clays, hydrogenation etc.).

SUMMARY OF THE INVENTION

The objective of the present invention is to improve the atmospheric distillation (phase 2) and vacuum distillation (phase 3) of the used oil after extraction with propane so that the process runs continuously, without frequent stops for cleaning and without corrosion of the equipment.

Another objective of the present invention is to achieve a level of quality of the base oils comparable to that of first refined oils, so that it is not necessary to carry out a final refining step using adsorbent clays or hydrogenation (phase 4).

Another objective of the process of the invention is to avoid problems of contamination by solid wastes, wastewaters or odours produced by current methods of solvent extraction.

Finally, the process of the invention achieves these objectives without using equipment or techniques that require a large investment cost or expensive maintenance such as catalytic hydrogenation or high vacuum thin-layer distillation.

DETAILED DESCRIPTION OF THE INVENTION

Figure 1:
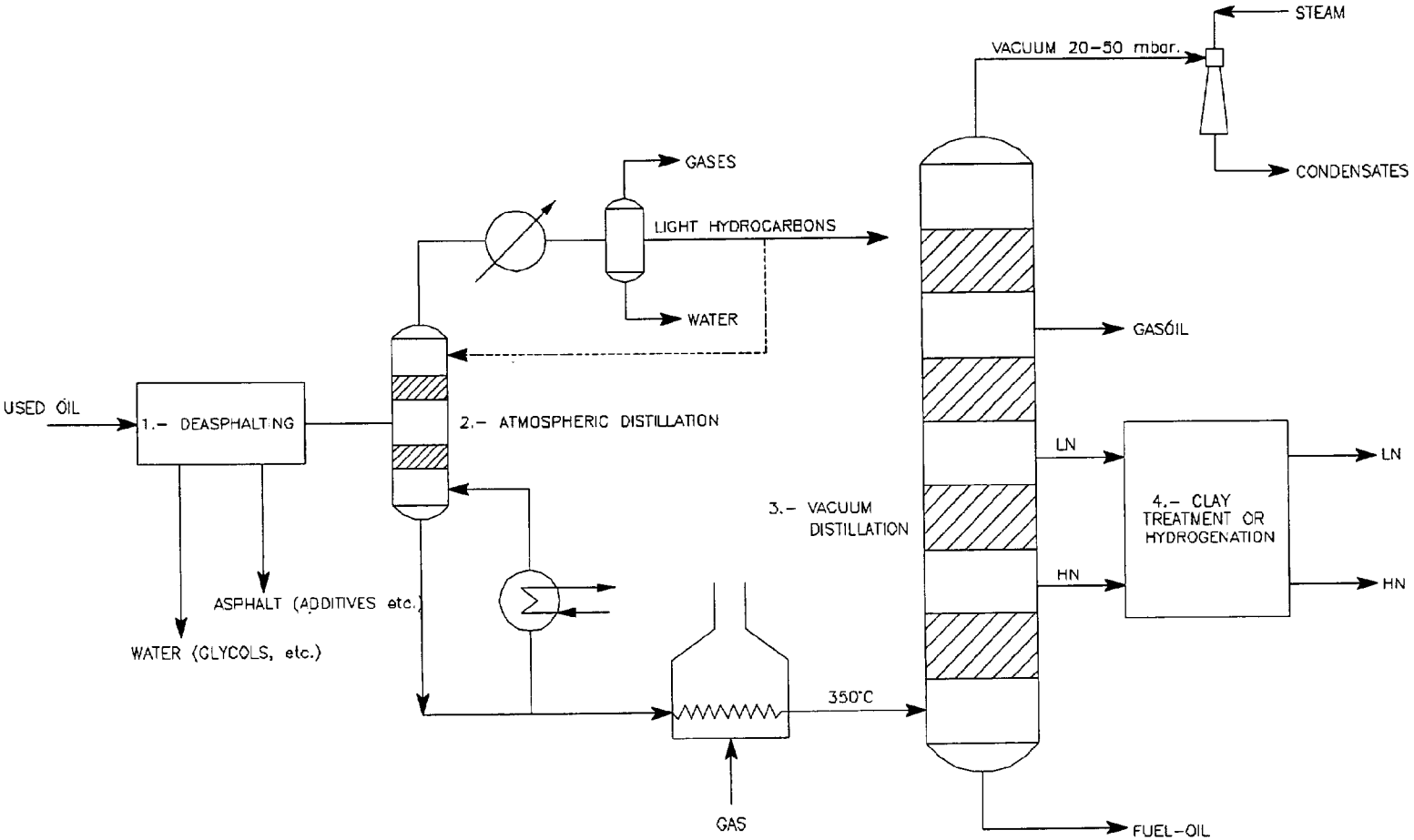
FIG. 1 illustrates a prior art process of used oil re-refining.

It has been discovered that fouling in the distillation heat exchangers is greatly reduced and that the properties of base oils are much improved, if the used oils, after being extracted with liquid propane, are distilled at moderate temperatures, reaching low vaporisation percentages in the exchangers and a high linear velocity along the exchanger tubes. For this purpose, the traditional atmospheric distillation tower is substituted by a flash vaporisation tower and the vacuum distillation is carried out at a moderate temperature using, in the vacuum distillation, recirculation of liquid to the feed.

The present invention provides a process by which used petroleum oils are regenerated by extraction with aliphatic solvents, characterised in that the process includes, after eliminating the extract solvent, the following steps:

a) Continuous Flash vaporisation, at atmospheric or near atmospheric pressure, to separate the light fractions in the presence of small amounts of a basic compound or reducing agent or a mixture of both.

b) Continuous distillation, in a fractionation column of the bottom liquid obtained in stage a) under moderate vacuum and temperatures; in the presence of a basic compound or a reducing agent or a mixture of both; with recirculation from the bottom of the column to its feed; separating, as side cuts, the vacuum gas-oil or spindle oil and the lubricant bases and a fuel-oil or asphaltic component at the bottom of the column.

Hence, the continuous flash vaporisation is carried out in the process of the invention, by preheating the deasphalted extract and transferring the liquid to a vapour-liquid separator.

This system has been shown to be much more effective than the packed or plate tower distillation, used in previous or classic technology, that requires a bottom reboiler, in which the liquid is submitted to temperatures of 250-300° C. to generate vapours in the stripping section of the column, producing, at these temperatures, rapid fouling in the reboiler and in the column bottom.

Similarly, the fractionating vacuum distillation is carried out, in the process of the invention, under vacuum and moderate temperatures, using packing materials of low pressure loss, so that the temperatures, to which the bases are submitted in the distillation process, remain below 350° C.

These conditions represent a clear advantage in comparison to deasphalting at temperatures of 350° C. that produce heat exchanger fouling and cracking of the lubricant bases, affecting their properties and making it necessary to perform a final refining step by hydrogenation.

The flash vaporisation of stage a) is carried out at temperatures between 150° C. and 260° C., preferably 220° C., and at atmospheric or near atmospheric pressure. The deasphalting extract, or feed, is preferentially heated at temperatures between 150 and 250° C. in a heat exchanger using a heating agent or thermal fluid at temperatures between 250° C. and 320° C. Then a liquid-vapour separation is carried out, with or without reflux of the distilled liquid light fractions to the top of the separator.

Preferably, the liquid separated in the flash vaporisation of stage a) is recirculated back to the feed and the ratio of recirculation to feed is between 0.5 and 5, expressed by weight. The continuous distillation of stage b) is carried out at temperatures between 310° and 335° C., and a pressure between 2 and 8 mbars. The vacuum is preferentially produced by a mechanical pump, the gases and vapours of which are burnt in a furnace with the help of liquid or gaseous fuels. Heating of the feed to the vacuum distillation column is preferentially done using a shell and tube heat exchanger and the heating agent is a thermal oil at temperatures between 350° C. and 390° C.

On the other hand, the pressure of the process of the invention is higher than that characteristic of thin-layer vaporisation processes (1 millibar) which results in a notable reduction in the size and complexity of the equipment. The level of reduced pressure used in the vacuum distillation (around 2 to 8 mbars), is achieved using mechanical vacuum pumps, a system preferred to steam ejector systems, because it avoids the production of large volumes of contaminated condensed water with an unpleasant odour that would require complicate contamination prevention devices. The outlet gases of the mechanical vacuum pump are taken to a gas or liquid fuel furnace where they are burnt to eliminate traces of the products that produce the odours.

Fouling of heat exchangers used in distillation at atmospheric pressure and at reduced pressure is favoured if the walls of the exchanger tubes reach high temperatures. This effect is reduced by avoiding direct heating of the tubes by combustion gases in furnaces. Heating is preferentially carried out in heat exchangers with an intermediate thermal fluid, which, is circulated outside of the tubes at around 250-320° C. in the flash distillation and at around 350-390° C. in the vacuum distillation.

Similarly, recirculation of the atmospheric distillation liquid or of the bottom liquid of the reduced pressure distillation has two beneficial effects in the tubes of the heat exchanger:

1) To increase the linear velocity and the turbulence regime, thus avoiding hot spots and deposits on the surface of the tubes.

2) To increase the liquid-vapour ratio, reducing the volume occupied by the vapours and avoiding the production of hot spots the tubes in contact with the vapour, where the heat transfer coefficient from the side of the process is much lower, and with it, the probability of deposits forming on the surface of the tubes.

Therefore, the distillation conditions of the process of the invention, and especially those of vacuum distillation, permit fouling and cracking reactions to be avoided without the use of excessively large apparatus such as that required for previous technologies of thin film evaporation.

Similarly, it has been discovered that, when the product, extracted with aliphatic solvents, is distilled under moderate temperature conditions, in the presence of a basic product (alkaline hydroxide), the characteristics of the base oils are notably improved, and, at the same time, the cleanliness of the system is increased and the corrosion disappears. The use of small amounts of alkaline hydroxides after separating the asphalts has not been described in solvent extraction re-refining processes of used oils.

The reaction temperatures of the alkaline hydroxides in other re-refining processes that do not use solvent extraction, range from 200-300° C. and this is done before or during separation of the asphalts, usually requiring an apparatus in which the oil and hydroxide are mixed together and react. In the process of the invention, the treatment carried out with a basic agent after separation of the asphalts, has different characteristics and conditions, as explained below:

a) The basic agent, generally introduced as an alkaline hydroxide in concentrated aqueous solution, loses water in the atmospheric flash distillation, becoming an anhydrous product with greater activity. Elimination of the water prevents having to use high-pressure equipment, equivalent to the vapour pressure of water at 200-300° C.

b) The anhydrous product is carried towards the fractionated distillation column under vacuum, where temperatures of 310 to 335° C. are reached, a range in which the rate of the reaction is much faster than those described in other processes, thus having a much greater refining effect.

c) At these temperatures and with an anhydrous product, mixing devices or reaction apparatus are not required and the distillation can be done in the presence of small amounts of basic agent to achieve the desired effect. The reactions occur preferentially in the circuit at the bottom of the vacuum column and in its recirculation to the column feed.

Similarly, it has also been found that the addition of small amounts of a reducing agent, in particular hydracine, in the distillation contributes to improving the quality of the lubricant bases obtained. Although the employment of hydracine to eliminate molecular oxygen from boilers, forming water and molecular $N_2$, as well as the use of hydracine as a reducer in organic reactions, are known, no reference has been found to its use in refining lubricant oils. Nevertheless, it is known that at the temperatures employed in the vacuum distillation temperatures, i.e. above 270° C., hydracine decomposes into $H_2$ and $N_2$.

Finally, given that the basic compound, after passing through the flash vaporisation zone and the fractionating vacuum distillation, finishes as part of the product of the column bottom, a process for its extraction of with water has been devised that permits its recovery and the reduction of the alkaline contents in the distillation column bottom.

In one specific application of the invention, the product from the base of the vacuum distillation column of phase b) is cooled, preferentially at temperatures between 80 and 160° C., and extracted with water at a pressure above that of the water vapour pressure corresponding to the temperature used, to dissolve and recover the basic compound and to reduce its contents in the column bottoms. In another specific application of the invention, continuous distillation in the fractionation column of stage b) is performed in two or more vessels in series.

It has been demonstrated that, the joint and simultaneous application of these principles, in the form illustrated in the description and in the examples, gives rise to results that cannot be obtained by the individual action of either of these. The application of the principles, described in this patent application, allow the specified objectives to be reached, this not being possible with existing processes for the re-refining of oils by solvent extraction.

Figure 2:
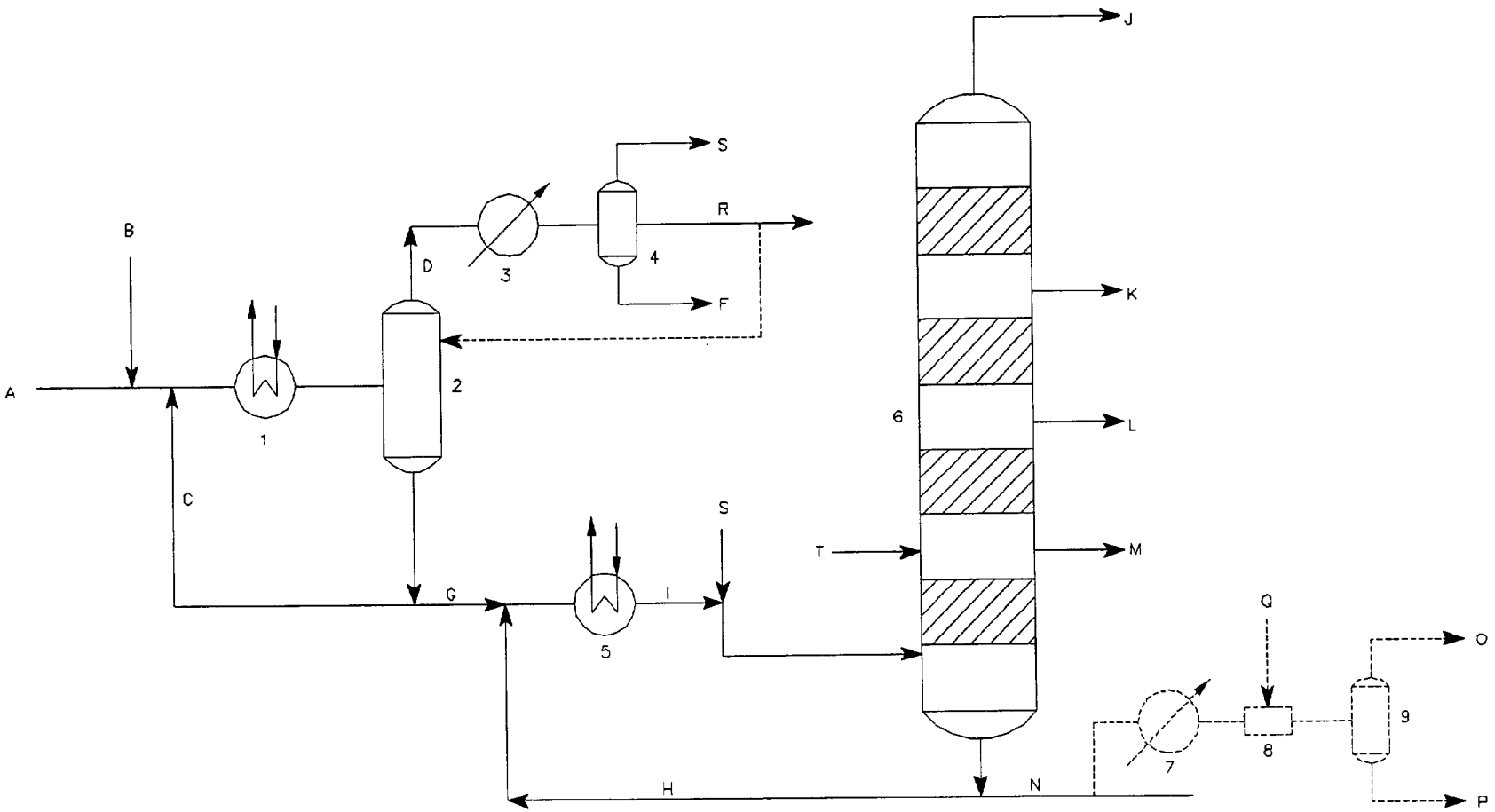
FIG. 2 illustrates a process of re-refining used oil in accordance with the teachings of the present invention.

FIG. 2 graphically outlines the process of the invention that is described in the following section.

The de-asphalted used oil A, to which the basic reagent B is added, is mixed with the recycle stream from the bottom of the flash vaporisation vessel C, and is preheated to temperatures preferentially within the range between 180° and 260° C. in heat exchanger 1, where a mixture of vapour and liquid occurs. This mixture is separated in vessel (2), obtaining a vapour stream D of light hydrocarbons, solvents and water, that are condensed in cooler (3) and separated in (4) as an upper layer of hydrocarbons R, a water phase F which is collected at the bottom and in non condensable gases S which leave at the top. Optionally, a part of R can be used as reflux in (2) to prevent the heavy fractions from being entrained with the top stream vapours of (2).

A part C from the bottom of the separator (2) is recirculated and mixed with A to reduce the percentage of vaporisation in (1) and to increase the linear velocity along the tubes of (1), thus controlling the tube fouling that may occur by deposition of heavy fractions and contaminants. The weight ratio of C to A is generally comprised between 1 and 5.

The remaining G from the separator bottoms, mixed with the recirculating current (H) from the bottom of the fractionation distillation column is heated in heat exchanger (5) to moderate temperatures, preferentially between 315 and 335° C. The vapour-liquid mixture (1) is introduced into the flash vaporisation zone of column (6). This column operates at reduced pressure (generally between 2 and 10 mbars at the top) and is designed with beds of low pressure loss packing material so that the pressure at the base is usually between 10 and 20 mbars, thus reaching the moderate temperatures previously indicated.

The fractionation column can be designed in such a way that two to five lateral extractions (side cuts) can be obtained. FIG. 1 shows a design of three extractions corresponding to the production of vacuum gas-oil or a spindle base oil K, a light base oil L and a heavy base oil M, which are sent to the respective storage tanks. The product from the bottom of the fractionation column (6) is divided into two currents. Current N is the production of fuel-oil that can also be used as an additive and fluidiser of asphalt and that is sent to storage; and current H is recirculated to the feed G of the fractionation distillation column, to control the tube fouling of exchanger (5) by reducing the vaporisation percentage and increasing the linear velocity along the tubes. The reducing additive can be added alone or in a mixture with the basic compound in several points of the unit labelled B, S and T. The best efficiency is achieved by adding the basic compound at B and the hydrogenating agent in the reflux of heavy oil T or in the flash vaporisation zone S.

Optionally, the basic agent that circulates through exchanger (1), separator (2), exchanger (5) and the bottom of tower (6) leaving in a mixture together with fuel-oil N, can be extracted with water and recirculated to B. To do this, current N from of column bottom (6) is cooled in exchanger (7), adding water Q in a mixer (8). The aqueous phase of the alkaline hydroxide P is separated from the fuel-oil in separator (9).

The diagram in FIG. 1 shows a simplified representation of a previous process according to the state of the art.

EXAMPLES

Example n°1

Process According to the State of the Art

As used oil, a product with the following characteristics was used:

| | |
|---|---|
| Color | dark |
| Flashpoint C.O.C. | 165° C. |
| Viscosity (ASTM D445) at 100° C. | 12.6 cst |
| $H_2O$ (ASTM D95) | 4.5% |
| Metals | 3500 ppm |
| Distillation ASTM D 1160 | |
| Initial point | 224.5 |
| Final point | 527.7 |
| Total Distilled (%) | 89.0 |

1000 kgs/h of this oil are extracted with 2500 kgs/h of liquid propane in a continuous system in accordance with the specifications of patent PCT US/99/116600. The mixture is continually pumped to a phase separator. The propane solution from the upper phase leaves, by distillation of the propane, 890 kg/h of extract.

The lower aqueous and asphaltic phase is pumped to a vaporiser, obtaining, as distillate, 45 kgs/h of water with a high COD contents, that is sent to an effluent water treatment plant, and, 65 kgs/h of a bottom asphaltic product that includes the additives and other contaminants.

The extract is pumped at a rate of 890 kgs/h to an atmospheric distillation column, obtaining 15 kgs/h of light fraction and 875 kgs/h of a bottom product that still contains 15 kgs/h of light fraction. The reboiler, heated with thermal oil to 375° C., to maintain 300° C. at the column bottom, requires frequent cleaning.

The bottom product, obtained in the atmospheric distillation column, is pumped at a rate of 875 litres/hour through a the tubular bundle of a natural gas furnace to achieve a temperature of 345° C. and is introduced into a fractionating distillation column, the upper part of which has a pressure higher than 20 mbars.

Following products are obtained:

60 kgs/h of vacuum gas-oil
350 kgs/h of light oil
310 kgs/h of heavy oil
135 kgs/h of fuel-oil The base oils have the following characteristics:

| | Light oil | Heavy oil |
|---|---|---|
| Viscosity at 100° C. (ASTM D445), cst. At 100° C. | 5.07 | 8.05 |
| Color (ASTM D1500) | 4 | 5 |
| Acidity (mg KOH/gr) | >0.10 | >0.10 |

The tubular bundle of the vacuum distillation column needs cleaning every 7-15 days and the packing material should be cleaned every six weeks.

This example also shows that the base oils obtained with the previous solvent extraction technology require a final refining step since they do not have a satisfactory color or acidity. Indeed, if the previous base oils are treated at 140° C. for 15 minutes, with 5% by weight of an adsorbent clay (containing CaO), the color would be reduced by 2 points and the acidity would remain around 0.04 mg KOH/gr.

Example n°2

Process According to the Invention

A total of 1,000 g of the same oil as that described in example 1 is extracted with propane, as indicated in that example, obtaining, after the separation of the propane, 890 kgs/h of the extract that is pumped together with 900 kgs/h of recirculation liquid across a heat exchanger heated with thermal fluid at 275° C. to a temperature of 225° C. The resulting mixture is taken to a liquid-vapour separator at atmospheric pressure. A total of 30 kg of light fractions is obtained at the top of the separator, while 1760 kgs/h are obtained at the vessel bottom, of which 900 kgs/h are recirculated to the feed. The bottom product of the flash atmospheric vaporization, 860 kgs/h, is mixed with 3500 kgs/h vacuum column bottoms and is heated in a shell and tube heat exchanger with a thermal oil at 370° C., to reach a temperature of 325° C., afterwards being introduced in the flash zone of a vacuum column packed with low pressure loss material. The pressure in its upper section is 5 mbars and in the lower section is 12 mbars.

Following products are obtained:

30 kgs/h of spindle oil
370 kgs/h of light oil
310 kgs/h of heavy oil
140 kgs/h of fuel-oil The base oils have the following characteristics:

| | Light oil | Heavy oil |
|---|---|---|
| Color | 2.5 | 3.0 |
| Acidity (mg KOH/gr) | 0.10 | 0.10 |

The feed exchanger of the vacuum column can be operated for a long time without requiring cleaning. The example shows that the design and operation of the distillation of the solvent extracted product using the process according to the invention, greatly increase the operability and improve the properties of the base oils although its quality does not reach the typical values of first refined oils.

Example n°. 3

Process According to the Invention

In example 2, a 50% in weight potassium hydroxide solution is added to the extract being pumped to the flash atmospheric vaporisation. It can be observed from the following table that the characteristics of the base oils improve as the amount of additive used is increased:

| KOH in gr/kg of extract | Color | Acidity |
|---|---|---|
| Light oil | | |
| 2.5 | 2.0 | 0.09 |
| 3.5 | 1.5+ | 0.06 |
| 5.0 | 1.5 | 0.03 |
| Heavy oil | | |
| 2.5 | 2.5 | 0.08 |
| 3.5 | 2.0+ | 0.05 |
| 5.0 | 2.0 | 0.02 |

This example shows that the design and operation of the distillation of the propane extract in accordance with the process of the invention, in the presence of a strong base in suitable proportions, leads to the production of re-refined oil bases of same quality as first refined base oils, without requiring a final refining step.

Example n°4

Process According to the Invention

In example n°.2 a total of 4.0 gr of KOH/kg of extract are added to the feed to the flash atmospheric vaporization and 0.2 gr. of hydracine/kg of extract are added to the reflux of the heavy oil from the vacuum distillation column, obtaining oil bases of the following characteristics:

| | Light oil | Heavy oil |
|---|---|---|
| Color (ASTM D 500) | <1.5 | <2.0 |
| Water (Karl-Fisher) % | <0.01 | <0.01 |
| Viscosity (ASTD D 445), cst at 100° C. | 5.3 | 8.0 |
| Acidity (mg KOH/gr) | 0.03 | 0.02 |
| Corrosion at the copper layer (ASTM D 130) | 1 a | 1 a |
| Viscosity index (ASTM D 2270) | >100 | >100 |
| Ramsbotton carbon (%) (ASTM D 524) | <0.05 | <0.05 |
| Aniline point (° C.) | 102 | 106 |
| Aromatic carbon (%) | 8.9 | 8.1 |
| Paraffin carbon (%) | 69.5 | 71.8 |
| Naphthenic carbon (%) | 21.6 | 20.1 |

This example shows that the addition of hydracine in the distillation carried out in the presence of a basic compound, in accordance with the invention, contributes to achieve the quality of first refined oils.

I claim:

1. A process to re-refine used petroleum oils, the process consisting of the following steps:

a. separating water and asphalts from the used petroleum oils by extraction with an aliphatic solvent, said solvent extraction being carried out at temperatures below 45° C., wherein said step a. produces a water phase, an asphalt phase and an aliphatic solvent phase through liquid solvent extraction;

b. eliminating the aliphatic solvent from the solvent extract containing extracted hydrocarbons;

c. flash, continuous vaporisation at atmospheric pressure or near atmospheric pressure, of the solvent free extracted hydrocarbons to separate light fractions in the presence of small amounts of a basic compound or a reducing agent or a combination of both; and d. continuous distillation in a fractionating column of a bottom liquid obtained in c., after separating the light fractions, at vacuum and moderate temperutures; in the presence of a basic compound or a reducing agent or a combination of both, with recirculation from a bottom of the column to a feed of the column; separating, as lateral extractions, vacuum gas-oil or spindle oil and lubricant bases and fuel-oil or asphaltic component as the bottom of the column.

2. The process according to claim 1, wherein the flash vaporisation of stage c is carried out at temperatures between 150° and 260° C., and atmospheric pressure or near atmospheric pressure; and that stage d is carried out at temperatures between 310° and 335° C. in the flash zone and a pressure between 2 and 8 mbars at the top of the column.

3. The process according to claim 2, wherein the basic compound used is an alkaline hydroxide or a mixture of alkaline hydroxides, and the reducing agent is hydracine; and in which the basic component is used in concentrations below 10 gr. per kg of solvent extracted product and the reducing compound in amounts below 5 gr. per kg. of solvent extracted product.

4. The process according to claim 1, wherein the flash vaporisation of stage c is carried out by heating the feed to temperatures between 150 and 250° C. in a heat exchanger using a thermal fluid at 250-320° C. and performing a continuous liquid-vapour separation with or without reflex of the distilled light fractions to the top of the separator.

5. The process according to claim 1, wherein the liquid separated in the flash vaporisation of stage c is recirculated to the feed, and the ratio of the recirculation stream to the feed is between 0.5 and 5, expressed by weight.

6. The process according to claim 1, wherein as heating agent of the heat exchanger of the feed to the flash vaporisation of stage c a thermal fluid is used heated to temperatures of 250 to 320° C.

7. The process according to claim 1, wherein the vacuum of the fractionated distillation column of staged is produced by a mechanical pump while the gases and vapours of said pump are incinerated in a furnace with the aid of liquid or gaseous fuels.

8. The process according to claim 1, wherein the ratio of the recirculation stream from the bottom of the fractionation column to the column feed in stage d is between 1 and 10, expressed by weight.

9. The process according to claim 1, wherein the heating of the feed to the vacuum distillation column of stage d is carried out with a shell and tube heat exchanger and the healing agent is a thermal oil at temperatures ranging from 350° C. to 390° C.

10. The process according to claim 1, wherein the product from the vacuum distillation bottom of phase d is cooled at temperatures ranging from 80 to 160° C., and extracted with water under pressure greater than the water vapour pressure, corresponding to the temperature used, to dissolve and recover the basic compound and to reduce its contents in the product of the column base.

11. The process according to claim 1, wherein continuous distillation in the fractionating column of stage d is carried out in two or more vessels in series.

12. The process according to claim 2, wherein the flash vaporisation of stage c is carried out at a temperature of between 210-230° C.

* * * * *